US009272760B2

(12) United States Patent
Bruce

(10) Patent No.: US 9,272,760 B2
(45) Date of Patent: Mar. 1, 2016

(54) ADJUSTABLE BOOT FOR A WATER SPORT DEVICE

(71) Applicant: John D. Bruce, Wake Forest, NC (US)

(72) Inventor: John D. Bruce, Wake Forest, NC (US)

( * ) Notice: Subject to any disclaimer, the term of this patent is extended or adjusted under 35 U.S.C. 154(b) by 50 days.

(21) Appl. No.: 14/448,480

(22) Filed: Jul. 31, 2014

(65) Prior Publication Data

US 2016/0031535 A1 Feb. 4, 2016

(51) Int. Cl.
*B63B 35/81* (2006.01)

(52) U.S. Cl.
CPC ..... *B63B 35/812* (2013.01); *B63B 2035/818* (2013.01)

(58) Field of Classification Search
CPC ..... B63B 35/812
USPC ..... 441/70; 280/617, 618, 607
See application file for complete search history.

(56) References Cited

U.S. PATENT DOCUMENTS 4,773,886 A * 9/1988 Teeter ..... B63B 35/812 280/11.3
4,891,027 A * 1/1990 Plunkett ..... B63B 35/812 441/68
5,116,073 A * 5/1992 Goud ..... A63C 9/005 280/617
5,794,962 A * 8/1998 Bardin ..... A63C 9/005 280/607
6,062,584 A * 5/2000 Sabol ..... A63C 10/14 280/14.24
6,174,212 B1 * 1/2001 Chang ..... B63B 35/812 280/607
6,290,423 B1 * 9/2001 Jungkind ..... A63C 10/10 280/607
6,786,502 B2 * 9/2004 Carlson ..... A63C 5/128 280/14.22
6,994,370 B2 * 2/2006 Sabol ..... A63C 10/18 280/618
2009/0325435 A1 * 12/2009 Cannon ..... B63B 35/812 441/70

* cited by examiner

*Primary Examiner* — Lars A Olson
*Assistant Examiner* — Jovon Hayes
(74) *Attorney, Agent, or Firm* — Coats & Bennett, P.L.L.C.

(57) ABSTRACT

A water sport device with an adjustable boot. The boot is mounted to a support on which the user rides. The boot includes separate toe and heel portions that are adjustable to fit the needs of the user, and to also accommodate different users. One or more rails extend along the support and provide for adjustment of the boot. Each of the one or more rails includes an adjustment mechanism that can be rotated by the user to move the toe and heel portions relative to each other to adjust the boot size. Each rail may also include a locking mechanism to prevent adjustment of the boot. When engaged, the locking mechanism may prevent any adjustment of the boot, or may prevent enlargement of the boot but allow for additional reduction in boot size.

17 Claims, 5 Drawing Sheets

ADJUSTABLE BOOT FOR A WATER SPORT DEVICE

BACKGROUND

The present application is directed to an adjustable boot for use with a water sport device such as water skis or waterboards and, more particularly, to an adjustable boot that is straight-forward to adjust and provides for secure fit for a user's foot.

Water sports in which a user is pulled across a surface of a body of water while riding on a support such as a board or ski continue to be popular. These water sports may include but are not limited to wakeboarding, kiteboarding, and water skiing. These sports include the user being pulled across the water by a variety of forces, including but not limited to a motorboat, pulley system, and wind power.

Basic equipment necessary for these sports includes one or more supports on which the user stands while being pulled. This may include the user using a single support such as a waterboard, or using a pair of supports such as water skis. Each of the supports is equipped with one or more boots each configured to receive a foot of the user. The boot is important to the overall functionality of the water sport device as it supports the user's foot and keeps the support attached to the user during use. A boot that is too large is not effective as it easily falls off during use. A boot that is too small is also ineffective because it is uncomfortable and/or not usable by the user.

Because a support may be used by different users, the boot may be adjustable to accommodate users with different feet sizes. This may include the boot being made from multiple sections that may be movable relative to each other to adjust to fit the size of the particular user.

A drawback of existing adjustable boots is the difficulty in adjusting the size to accommodate the user's foot. The mechanism for adjusting the size may be difficult to use. This may include difficulty in adjusting the size of the boot, or the inability to properly size the boot for a particular user. Further, the boots are often not durable and have a limited life expectancy. The relatively short life expectancy is caused by the stresses applied to the boot by the user during use, as well as the various impacts encountered when the user falls from the device while being pulled across the water.

SUMMARY

The present application is directed to a water sport device that includes an adjustable boot. The boot is mounted to a support on which the user rides. The boot includes separate toe and heel portions that are adjustable to fit the needs of the user, and to also accommodate different users. One or more rails extend along the support and provide for adjustment of the boot. Each of the one or more rails includes an adjustment mechanism that can be rotated by the user to adjust the boot size. Each rail may also include a locking mechanism to prevent adjustment of the boot. When engaged, the locking mechanism may prevent any adjustment of the boot, or may prevent enlargement of the boot but allow for additional reduction in boot size.

One embodiment is directed to a water sport device for a user to ride over the surface of a body of water. The device includes a support member to support the user on the surface of the body of water. The support member includes opposing top and bottom sides. A boot is positioned on the top side of the support member and includes a toe portion and a separate heel portion. A rail is positioned on the top side of the support member and extends along a lateral side of the boot between the boot and an outer edge of the support member. The rail includes a first section connected to the toe portion and a second section connected to the heel portion. The first and second sections are spaced apart on the top side of the support member by a gap. Each of the first and second sections includes a row of teeth that face inward towards the gap. An adjustment mechanism is connected to the rail and includes a gear with teeth that extend around a periphery. The gear is positioned in the gap between the first and second sections with the teeth of the gear engaging with the row of teeth on each of the first and second sections. The adjustment mechanism also includes a handle operatively connected to the gear with rotation of the handle resulting in rotation of the gear. The gear and the handle are configured to rotate in a first direction to move the first and second sections and simultaneously move the toe section and the heel section together to reduce a size of the boot, and to rotate in a second direction to move the first and second sections and simultaneously move the toe section and the heel section apart to enlarge the size of the boot.

The water sport device may also include a locking mechanism attached to the rail and movable between locked and unlocked positions with the locking mechanism including an engagement tooth sized to engage with a row of locking teeth on the first section in the locked position to prevent movement of the first and second sections that enlarge the boot.

The engagement tooth and the row of locking teeth may include angular faces to provide sliding movement of the first section relative to the engagement tooth while the locking mechanism is in the locked position to reduce the size of the boot while simultaneously preventing sliding movement of the first section relative to the engagement tooth to enlarge the size of the boot.

The water sport device may include that each of the first and second sections is arranged in an overlapping and parallel orientation between the boot and an outer edge of the support member.

The gear may remain in constant contact with each of the rows of teeth on the first and second sections.

Another embodiment is directed to a water sport device for a user to ride over the surface of a body of water. The device includes a support member to support the user on the surface of the body of water with the support member including a first side on which the user stands and an opposing bottom side. A boot is positioned on the top side and includes a toe portion and a heel portion that are separate from one another. First and second rails are mounted to the first side of the support member and extend along opposing lateral sides of the boot. Each of the rails includes: first and second elongated members aligned in an overlapping arrangement between the boot and an outer edge of the support member with the first and second elongated members being movable relative to the support member and the first elongated member being attached to the toe portion and the second elongated member being attached to the heel portion; a first row of engagement teeth that extend along a first section of the first elongated member; a second row of engagement teeth that extend along the second elongated member. A first adjustment mechanism is mounted to the first rail and a second adjustment mechanism is mounted to the second rail. Each of the adjustment mechanisms are configured to rotate in first and second directions and include a gear positioned between the first and second elongated members with gear teeth engaged with both the first and second rows of the engagement teeth. The gear of each of the adjustment mechanisms is engaged with each of the first and second rows of engagement teeth with rotation of the gear in a first direction moving the first and second elongated members and moving the toe portion and the heel portion together, and rotation of the gear in the second direction moving the first and second elongated members and moving the toe portion and the heel portion apart.

The water sport device may also include that each of the first and second rails includes a third elongated member fixedly attached to the support member and aligned with the first and second elongated members.

The water sport device may also include a first locking member mounted to the first rail and a second locking member mounted to the second rail with each locking member including: an engagement member with a tip sized to engage with the locking teeth; and a biasing member to bias the locking tooth into engagement with the locking teeth. The engagement member may be movable between locked and unlocked orientations with the engagement member preventing relative movement of the toe and heel portions away from each other in the locked orientation and allowing for relative movement of the toe and heel portions away from each other in the unlocked orientation.

Each of the adjustment mechanisms may include a handle that extends outward above the first side of the support member with each of the handles connected to the corresponding gear such that rotation of the handle rotates the gear.

Each of the first and second elongated members of each of the rails may be arranged in an overlapping and parallel orientation between the boot and an outer edge of the support member.

Each of the gears may remain in constant contact with the first and second rows of the engagement teeth.

Another embodiment is directed to a method of adjusting a boot on a water sport device. The method includes separating a heel portion of the boot from a toe portion of the boot thereby moving first and second elongated members of a rail that extends along the boot to a first orientation with the first elongated member being connected to the toe portion and the second elongated member being connected to the heel portion. The method includes rotating a gear that is positioned between and engaged with each of the first and second elongated members and moving each of the first and second elongated members along the gear to a second orientation thereby simultaneously moving the toe portion and the heel portion towards one another. The method includes engaging an engagement tooth on a locking mechanism with a row of locking teeth on one of the first and second elongated members and preventing movement of the first and second elongated members that separates the toe portion and the heel portion. The method also includes that while the engagement tooth of the locking mechanism is engaged with the row of locking teeth, rotating the gear and moving the each of the first and second elongated members along the gear to a third orientation and simultaneously moving the toe portion and the heel portion towards one another.

The method may also include ratcheting the engagement tooth along the row of locking teeth while moving the first and second elongated members from the second orientation to the third orientation.

The method may also include biasing the engagement tooth in a first direction and into engagement with the row of locking teeth.

The method may also include disengaging the engagement tooth from the row of locking teeth and rotating the gear in an opposing direction and moving the first and second elongated members from the third orientation to the first orientation thereby moving the toe portion and the heel portion apart.

The method may also include moving the first and second elongated members from the first orientation to the second orientation and into a greater amount of overlap.

The method may also include rotating the gear through a handle that extends from the gear and that extends above a support to which the boot is attached.

The various aspects of the various embodiments may be used alone or in any combination, as is desired.

DETAILED DESCRIPTION

The present application is directed to a water sport support with an adjustable boot. The boot includes toe and heel sections that are movably mounted to rails. An adjustment mechanism includes a handle that is positioned to be grasped by a user and a gear engaged with the rail. Rotation of the handle by the user causes the gear to move the rails relative to one another to adjust the spacing between the toe and heel sections to adjust an overall size of the boot. A locking mechanism engages the rail to limit movement of the toe and heel sections.

Figure 1:
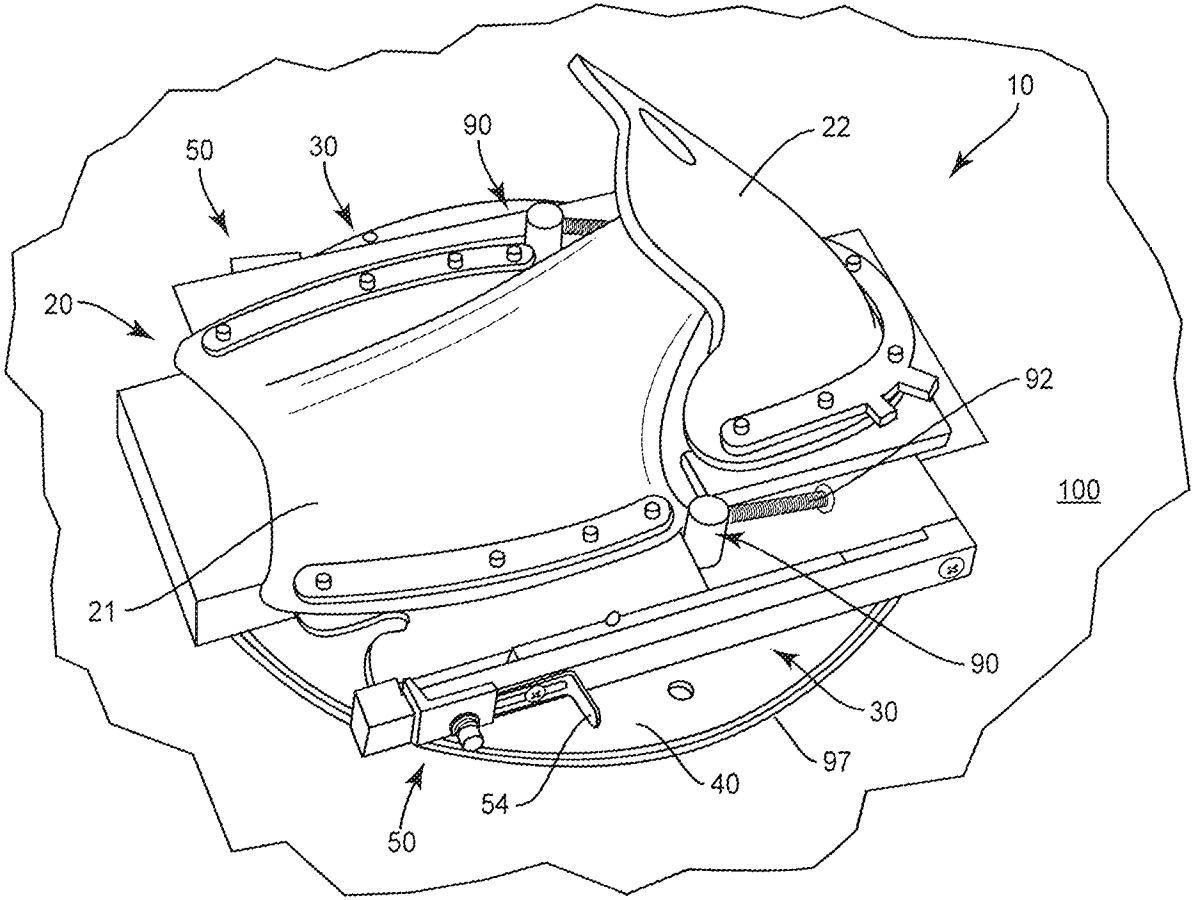
FIG. 1 is a perspective view of a water sport device with an adjustable boot.

FIG. 1 illustrates a perspective view of the water sport device 10 with an adjustable boot 20 attached to a top of a support 100. The boot 10 includes a toe section 21 positioned towards a front of the support 100 and a heel section 22 positioned towards a rear of the support 100. The sections 21, 22 are each movable relative to the support 100 and relative to each other to accommodate a variety of different foot sizes. The sections 21, 22 may be constructed from rubber and be flexible and/or pliable to conform to the shape of the foot. The toe section 21 may be shaped to extend over the top of the user's foot and include an open toe section and an open back for the user to insert their foot. The heel section may be shaped to extend around the back of the user's heel/leg.

A mounting plate 40 is positioned between the boot 20 and the support 100. The mounting plate 40 provides for mounting and positioning the boot 20 relative to the support 100. The mounting plate 40 may be fixedly attached to the support 100 with one or more fasteners and/or adhesive. In one embodiment, the mounting plate 40 is rotatably attached to the support 100 to adjust the angular positioning of the boot 20 to accommodate the needs of the user. By way of example, a user may prefer a first angular orientation of the boot 20 relative to the support 100 while performing a first type of activity, and a different second angular orientation for a different activity. Further, different users may prefer different angular orientations. A pad 97 may be positioned between the support 100 and the mounting plate 40. The pad 97 may protect the support 100 and prevent scratching or other damage. The pad 97 may be attached by adhesives and/or fasteners.

Each of the toe section 21 and the heel section 22 are mounted to a pair of rails 30. The rails 30 provide for adjusting the spacing between the sections 21, 22 and thus the overall size of the boot 20. The rails 30 in turn are mounted to the mounting plate 40 by one or more fasteners. In one embodiment, the rails 30 are attached to the plate 40 by one or more fasteners, with the plate 40 being mounted to the support 100 by one or more different fasteners. In one specific embodiment, the fasteners extend from a bottom of the plate 40 and into the rails 30. The fasteners include a tapered head and mount into countersunk holes in the plate 40 such that the fasteners do not extend outward beyond a bottom surface of the plate 40.

A first rail 30 extends along a first lateral side of the boot 20 and a second rail 30 extends along an opposing second lateral side. The rails 30 are spaced apart. In one embodiment, each of the rails 30 is substantially straight and the pair of rails 30 are aligned in a parallel orientation.

The sizing of the boot 20 is adjusted by an adjustment mechanism 90 associated with each of the rails 30. The adjustment mechanism 90 includes a handle 92 that is accessible to the user. The handle 92 is rotated by the user to adjust the rail 30 and thus the spacing between the toe and heel sections 21, 22. Each rail 30 also includes a lock mechanism 50 to prevent the inadvertent separation of the sections 21, 22 (and thus an enlargement of the boot 20). The locking mechanisms 50 are biased towards a locked position to prevent the sections 21, 22 from being inadvertently moved away from each other. Each lock mechanism 50 also includes a grip 54 that is pulled by the user to move the lock mechanism 50 to an unlocked orientation.

Figure 2:
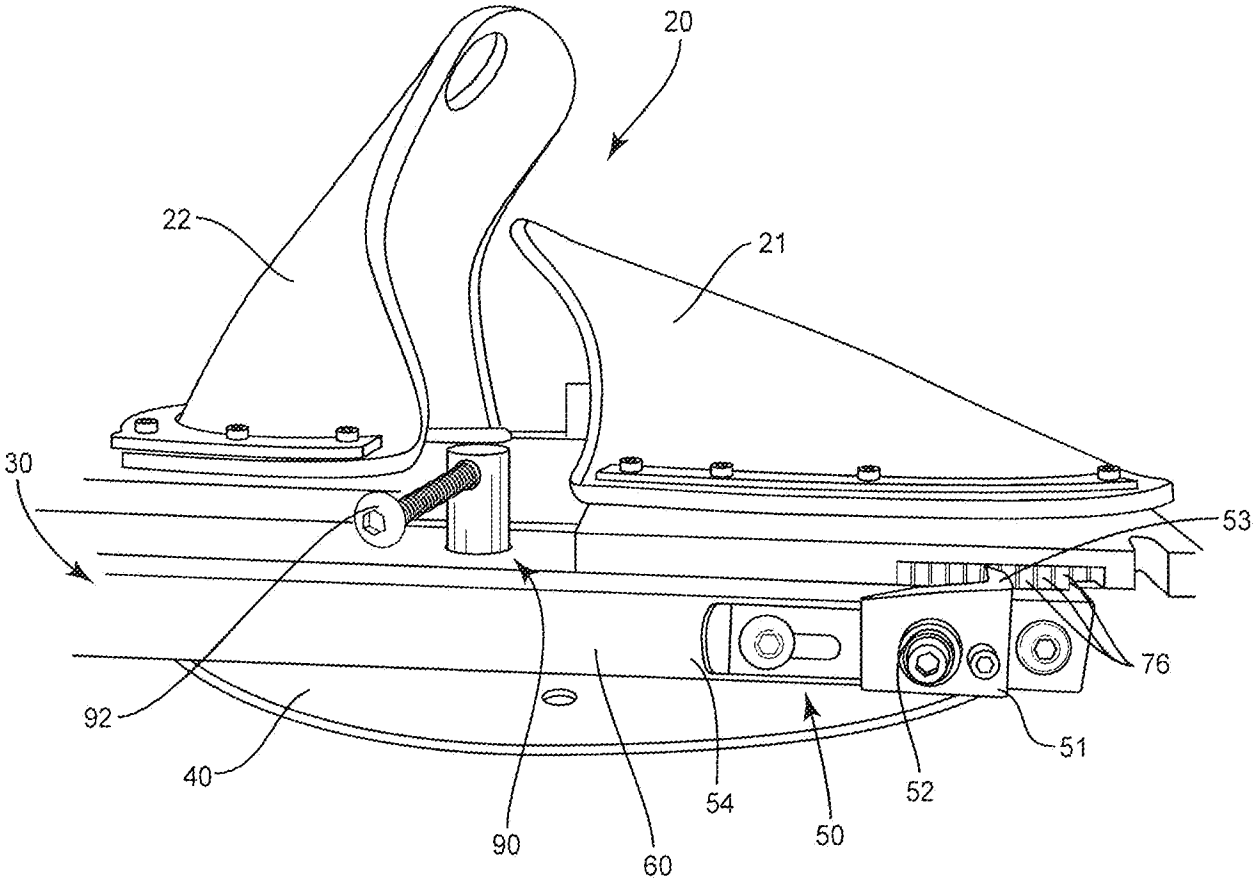
FIG. 2 is a side view of an adjustable boot.

FIG. 2 illustrates a side view that includes the boot 20 positioned on the rails 30 and connected to the mounting plate 40 (the pad 97 and support 100 are not illustrated in FIG. 2). The locking mechanism 50 engages with one of the corresponding teeth 76 on the rail 30 as will be explained in more detail below. The handle 92 of the adjustment mechanism 90 is positioned for straight-forward access and rotation by the user.

Figure 3:
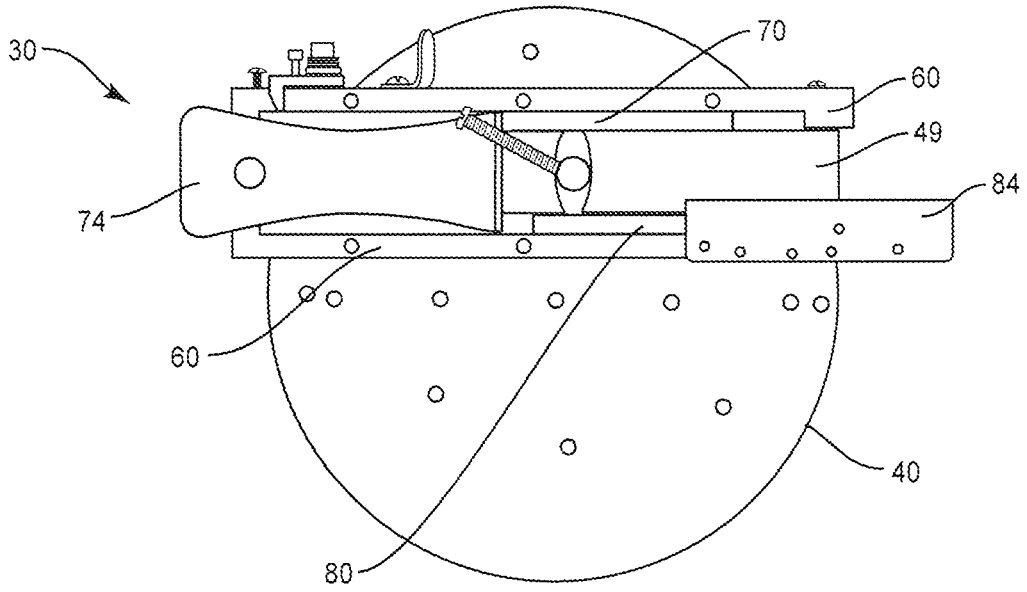
FIG. 3 is a top view of a rail with an adjustment mechanism and a locking mechanism.
Figure 4:
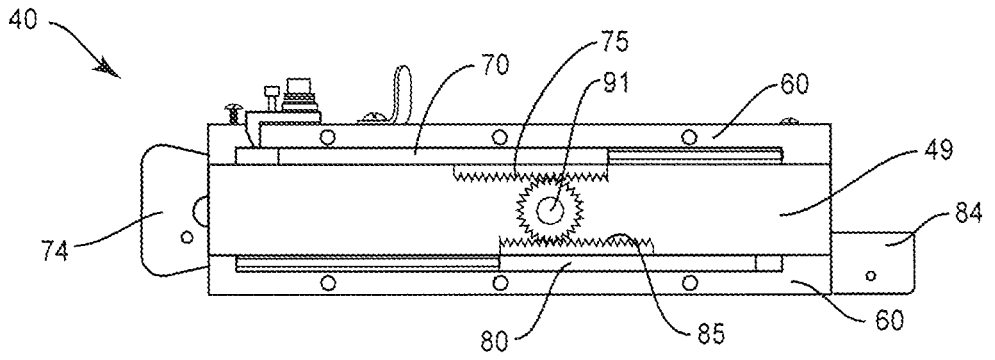
FIG. 4 is a bottom view of a rail that includes the adjustment mechanism and the locking mechanism.

Each rail 30 includes a pair of outer elongated members 60 positioned on opposing sides of intermediate first and second elongated members 70, 80. FIG. 3 illustrates a top view of one of the rails 30 that include the two elongated members 60 that extend around the intermediate elongated members 70, 80. FIG. 4 illustrates a bottom view of the rail 30.

The outer elongated members 60 are positioned apart from one another to create a space for the intermediate elongated members 70, 80. Each of the members is substantially straight and is attached to the mounting plate 40 through one or more fasteners. Each of the members 60, 70, 80 includes a height to extend upward from the top of the plate 40 and the support 100. The members 60, 70, 80 may be constructed from a variety of different materials, including but not limited to metal and plastic.

The intermediate members 70, 80 are positioned between the two outer members 60. The first elongated member 70 is attached to the toe section 21, and the second elongated member 80 is attached to the heel section 22. The members 70, 80 are each movable relative to the outer elongated members 60 and to each other to adjust the spacing between the sections 21, 22. The members 70, 80 are positioned in an overlapping arrangement between the outer members 60 (as illustrated in FIGS. 3 and 4) with the extent of overlap depending upon the relative positioning with the gear 91.

The two elongated members 60 are spaced apart on the top side of the plate 40 and the support 100 and form a channel to position the first and second elongated members 70, 80. A first one of the members 60 is positioned in proximity to the boot 20 and a second one of the members 60 is positioned laterally farther away from the boot 20. The two members 60 may include the same shape and size, or may include different shapes and/or sizes.

Figure 5:
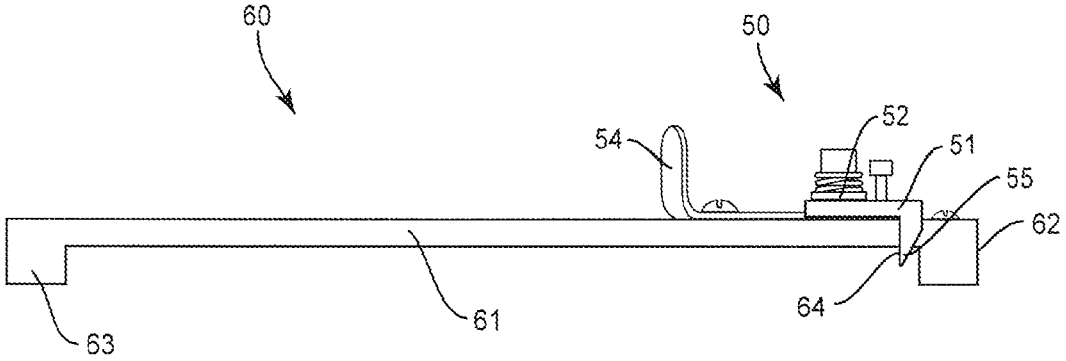
FIG. 5 is a top view of a first elongated member of a rail and a locking mechanism.

FIG. 5 illustrates an outer elongated member 60. This member 60 is positioned laterally away from the boot 20 and is equipped with a locking mechanism 50 as will be explained below. The elongated member 60 includes a body 61 with a first end 62 that is positioned towards the front of the support 100 and a second end 63 positioned towards the rear of the support 100. The inner lateral surface of the member 60 that forms the channel may be smooth to facilitate sliding of the one of the first and second elongated members 70, 80 that abuts against it.

In the elongated member 60 of FIG. 5, the body 61 includes an outer lateral surface that supports and receives the locking mechanism 50. An opening 64 in the body 61 is positioned towards the first end 62 and is sized to receive the tip of the engagement member 51 such that the tooth 55 can engage with the locking teeth 76 of the first elongated member 70. In one embodiment, the opening 64 includes a pair of spaced apart apertures and the engagement member 51 includes a forked shape with first and second fingers that are sized and shaped to extend through the respective apertures.

Figure 6:
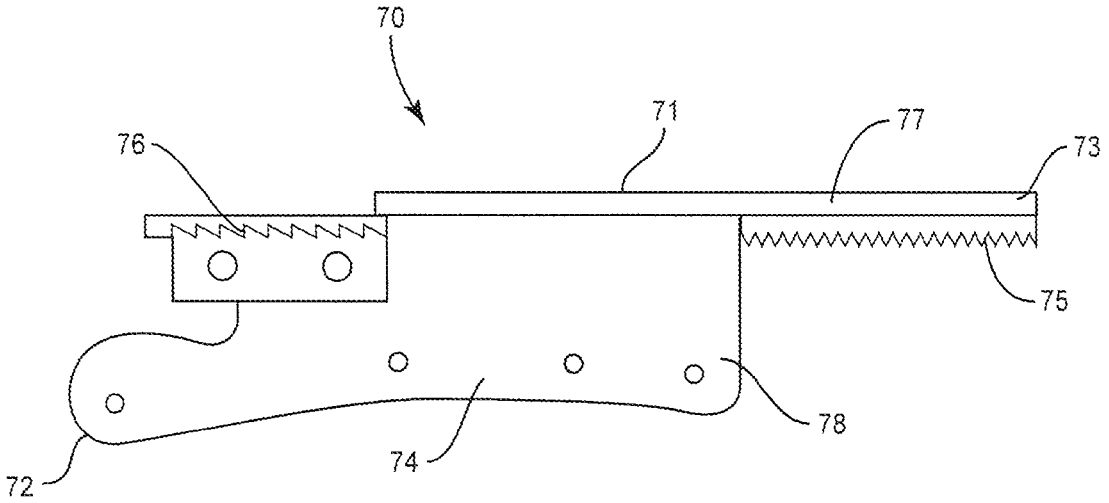
FIG. 6 is a plan view of a second elongated member.

The first intermediate elongated member 70 is attached to the toe section 21 and provides for adjusting the position of the toe section 21 in forward and rearward directions. As illustrated in FIGS. 3, 4, and 6, the first elongated member 70 includes a body 71 with a first end 72 that is positioned towards the front of the support 100 and a second end 73 positioned towards the rear of the support 100. The body 71 includes a first section 77 with an outer lateral surface that abuts against and slides along the first elongated member 60. The body 71 also includes a second section 78 that mounts to the toe section 21.

The first section 77 of the body 71 includes a substantially straight lateral side that abuts against and slides along a lateral side of the body 61 of the outer elongated member 60. Each of the lateral side of the first section 77 and the body 61 of the outer elongated member 60 may be smooth to facilitate the sliding movement. Because the outer elongated member 60 is fixedly attached to the plate 40 and the support 100, the abutment between the first section 77 of body 71 and body 61 prevents outward lateral movement of the elongated member 70 which could cause disengagement from the gear 91. A row of teeth 75 extend along a length of the first section 77 to engage with the gear 91. These teeth 75 provide for movement of the member 70 in forward and rear directions.

The second section 78 of the body 71 includes a planar shape and forms a mounting plate 74 to mount the toe section 21. The mounting plate 74 may include apertures to receive fasteners for mounting the toe section 21. The second section 78 may include a planar shape and extend laterally inward from the first section 77 towards a center of the support 100 when the member 70 is mounted on the support 100. The second section 78 may be perpendicular to the first section 77.

The member 70 also includes locking teeth 76 that engage with the locking mechanism 50. The locking teeth 76 are arranged in a row and face laterally outward. As illustrated in FIG. 6, the teeth 76 may be mounted to an underside of the second section 78 and at an end of the first section 77.

Figure 7:
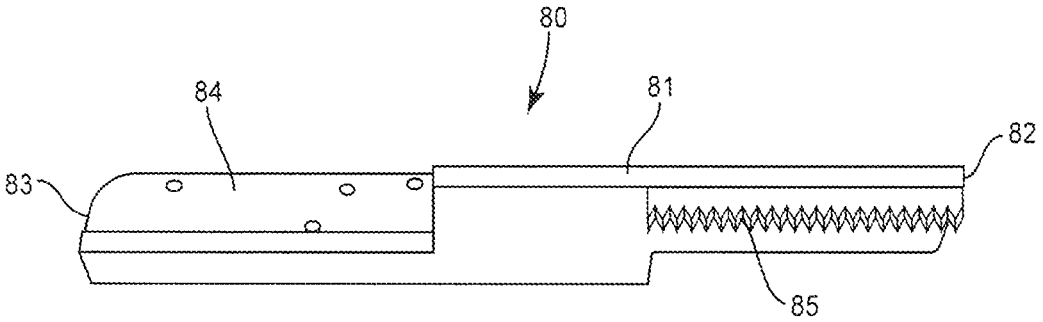
FIG. 7 is a perspective view of a third elongated member.

The second intermediate elongated member 80 is attached to the heel section 22 and provides for adjustment relative to the toe section 21. As illustrated in FIGS. 3, 4, and 7, the member 80 includes an elongated body 81 with a first end 82 that is positioned towards the front of the support 100 and a second end 83 positioned towards the rear. A lateral surface of the body 81 may be smooth to facilitate sliding along the inner lateral side of the outer elongated member 60 against which it abuts. A mounting plate 84 is positioned towards the second end 83 to receive the heel section 22. Apertures in the plate 84 are configured to receive fasteners to attach the heel section 22. A row of teeth 85 are positioned along the body 81 and are configured to engage with the gear 91.

Each of the intermediate members 70, 80 are configured to move linearly in forward and rearward directions. This movement is limited to sliding motion along the outer elongated members 60 which prevent movement in other directions (e.g., lateral movement away from one another) that may cause the disengagement from the gear 91. In one embodiment, the members 70, 80 move in planes parallel to one another. In one embodiment as illustrated in FIGS. 3 and 4, an intermediate positioning member 49 is positioned between the second and third elongated members 70, 80. The positioning member 49 includes a relatively flat elongated shape with flat relatively thin laterals sides. A first lateral side faces towards and abuts against the first elongated member 70. An opposing second lateral side faces towards and abuts against the second elongated member 80. The lateral sides form guides against which the inner lateral sides of the elongated members 70, 80 slide during adjustment of the boot 20. The width of the intermediate member 49 maintains the elongated members 70, 80 abutted against the outer elongated members 60. Additionally, the intermediate positioning member 49 is positioned over the gear 91 such that the gear 91 is located between the member 49 and the mounting plate 40. In one embodiment, the intermediate positioning member 49 is fastened to the support member 100.

The adjustment mechanism 90 provides for the user to adjust the size of the boot 20 by moving the intermediate elongated members 70, 80 (and thus the attached toe and heel sections 21, 22). The adjustment mechanism 90 includes the gear 91 that is connected to a handle 92. The adjustment mechanism 90 is mounted with the gear 91 positioned on the underside to engage with the teeth 75, 85 of the elongated members 70, 80 respectively, and the handle 92 on the upper side to be contacted by the user. In one embodiment, the adjustment member 90 extends through an aperture in the intermediate member 49 that is positioned between the intermediate elongated members 70, 80.

The gear 91 includes a generally circular shape with teeth positioned around the periphery. The gear 91 and the gear teeth are sized and shaped to simultaneously engage with the teeth 75, 85 of the second and third elongated members 70, 80. The handle 92 may include a variety of different sizes and configurations that can be grasped by the user. The gear 91 and handle 92 are connected such that rotation of the handle 92 causes rotation of the gear 91.

The intermediate elongated members 70, 80 are movable relative to one another through the gear 91. Thus, a user can rotate the handle 92 in a first direction to cause the elongated members 70, 80 to move outward to enlarge the size of the boot 20, and rotate the handle 92 in a second direction to move the elongated members 70, 80 inward to reduce the size of the boot 20. In one embodiment, the gear 91 and elongated members 70, 80 form a rack and pinion mechanism that acts as a linear actuator to convert the rotation motion of the gear 91 into linear motion of the elongated members 70, 80.

The locking mechanism 50 is attached to the laterally outward elongated member 60 to prevent inadvertent enlargement of the boot 20. As best illustrated in FIGS. 2 and 5, the locking mechanism 50 includes an engagement member 51 with a tooth 55 sized and shaped to engage with one of the teeth 76 on the first elongated member 70. A biasing member 52 biases the tooth 55 into engagement with the teeth 76 along the elongated member 70. A grip 54 is attached to the engagement member 51 and is movable along the lateral side of the first elongated member 60. Movement of the grip 54 along the first elongated member 60 causes the engagement member 51 to move outward and to disengage the tooth 55 from the teeth 76. In one embodiment, a ramp extends outward from the lateral side of the first elongated member 60. Sliding movement of the grip 54 causes the engagement member 51 to slide along the ramp and move laterally outward thus disengaging the tooth 55 from the teeth 76. The grip 54 may include an engagement portion that extends outward away from the body 61 of the first elongated member 60 to facilitate contact by the user.

Figure 8:
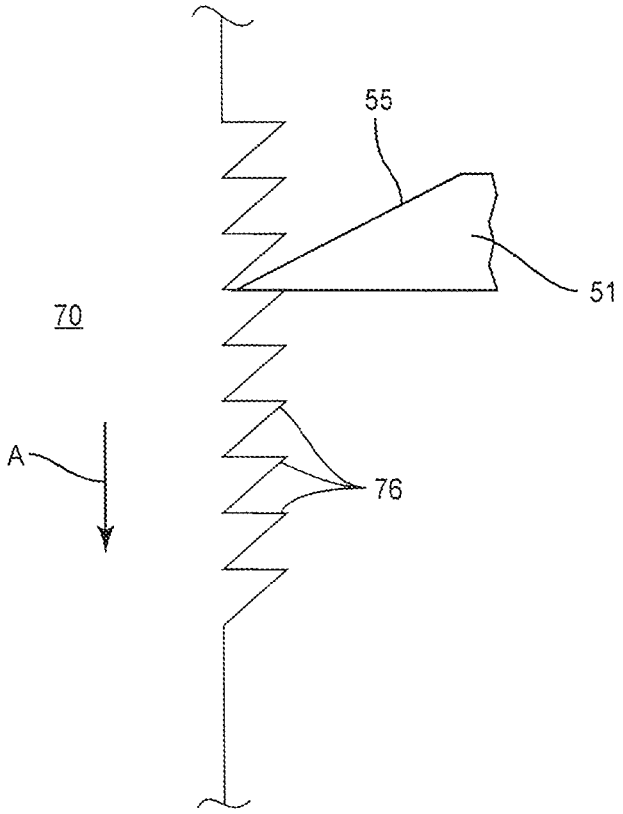
FIG. 8 is a schematic view of teeth on the second elongated member engaged with a tooth on the engagement member of the locking mechanism.

The shapes of the teeth 55, 76 may provide for limited adjustment of the boot 20 with the locking mechanism in the locked orientation. As illustrated in FIG. 8, teeth 55, 76 may be configured to allow movement of the elongated member 70 in a first direction indicated by arrow A when the tooth 55 is engaged with one of the teeth 76. This allows for a user to reduce the size of the boot 20 with the locking mechanism 50 in the locked orientation. The teeth shapes further prevent opposing movement in the second direction thus prevent enlargement of the boot 20. Thus, during use, a user is able to simply rotate the handle 92 of the adjustment mechanism 90 to reduce the size of the boot 20.

During additional tightening of the boot 20, the movement of the locking teeth 76 along the tooth 55 may cause a ratcheting motion of the engagement member 51. The tooth 55 may slide along the angled faces of the teeth 76 thus causing the engagement member 51 to overcome the force of the spring 52 and move away from the elongated member 60. Once the tooth 55 moves beyond the particular tooth 76 in the row, the tooth 55 is biased into the adjacent valley. This ratcheting movement may provide a tactile and/or audible signal to the user to indicate the movement and the reduction in boot size.

The locking mechanism 50 and teeth 75 may also be configured to prevent any movement of the elongated member with the locking mechanism 50 in the locked orientation. The angular shape of the tooth 55 and teeth 76 prevent movement of the row of teeth 76 relative to the tooth 55 in the opposing direction. In one embodiment, each of the teeth 50, 75 includes substantially straight contact faces. These contact faces prevent any movement of the first elongated member 70 relative to the engagement member 51 of the locking mechanism 50.

The device 10 may include rails 30 on each side of the boot 20 as illustrated in FIG. 1. A first rail 30 with a first adjustment mechanism 90 and locking mechanism 50 are positioned along a first lateral side of the boot 20. A second rail 30 with a second adjustment mechanism 90 and locking mechanism 50 are positioned along an opposing second lateral side of the boot 21. The device 10 may also include a pair of rails 30 on opposing sides of the boot 21 (as illustrated in FIG. 1), but instead just a single one of the rails 30 includes an adjustment mechanism 90. Likewise, each of the pair of rails 30 may include a locking mechanism 50, or just one of the pair may include a locking mechanism 50.

The device 10 provides for the user to adjust the size of the boot 20 to fit their needs. In use, the boot 20 may start in an open orientation with the toe and heel sections 21, 22 widely separated. In this open orientation, the user is easily able to insert their foot into the boot 20 between the two and heel sections 21, 22.

Once their foot is inserted in the enlarged boot 20, the user is then able to rotate the adjustment mechanisms 90 to reduce the size of the boot 20. This includes the user rotating the handle 92 thus causing rotation of the attached gear 91. The rotation of gear 91 causes the gear teeth to engage with the teeth 75, 85 respectively on the first and second elongated members 70, 80 thus causing the members to linearly move past one another. The movement of each of the first and second elongated members 70, 80 results in simultaneous movement of both the toe and heel portions 21, 22. The user is able to rotate the handle 92 to adjust the boot 20 to the desired size.

In some embodiments, the one or more locking mechanisms 50 are moved to the unlocked orientation prior to adjusting the size. This may be necessary because the first and second elongated members 70, 80 are fixed in position when the locking mechanism 50 is locked. In these embodiments, the one or more locking mechanisms 50 are unlocked while the user adjusts the size of the boot 20. Once complete, the user moves the one or more locking mechanisms 50 to the locked orientation.

In other embodiments, the user is able to adjust the adjustment mechanism 90 to reduce the size of the boot 20 while the locking mechanism 50 is in the locked orientation. The user simply rotates the handle 92 in the one direction to reduce the boot size. The locking mechanisms 50 remain engaged once the size is established.

In one embodiment, moving the locking mechanism 50 to the unlocked position includes the user pulling the grip 54 backward (i.e., towards the heel section 22) to move the engagement member 51 and disengage the tooth 55. To move to the locked position, the movement is reversed by the user pushing the grip forward (i.e., away from the heel section 22) to engage the tooth 55 with the row of locking teeth 76.

The support 100 provides a platform on which the user stands and rides. The support 100 may include a variety of shapes and sizes, with generally the top side of the board configured to receive the boot 20 and provide for the user to stand with the opposing second side being shaped and configured to contact with the water. The device 10 may include a variety of different configurations, including but not limited to water skis and waterboards. The various devices 10 may include a single boot 20 per support 100, or may include multiple boots 20 on each support 100.

The various embodiments have described a pair of rails 30 extending along opposing lateral sides of the boot 20. The device 10 may also include a single rail 30 extending along a side of the boot 20.

In various embodiments, the device 10 may include a locking mechanism 50 on each rail 30. The device 10 may also include a locking mechanism 50 on just a single rail 30.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A water sport device for a user to ride over the surface of a body of water, the device comprising:

a support member to support the user on the surface of the body of water, the support member comprising opposing top and bottom sides;

a boot positioned on the top side of the support member, the boot comprising a toe portion and a separate heel portion;

a rail positioned on the top side of the support member and extending along a lateral side of the boot between the boot and an outer edge of the support member, the rail comprising a first section connected to the toe portion and a second section connected to the heel portion, the first and second sections being spaced apart on the top side of the support member by a gap, each of the first and second sections including a row of teeth that face inward towards the gap;

an adjustment mechanism connected to the rail and comprising a gear with teeth extending around a periphery, the gear positioned in the gap between the first and second sections with the teeth of the gear engaging with the row of teeth on each of the first and second sections, the adjustment mechanism also including a handle operatively connected to the gear with rotation of the handle resulting in rotation of the gear;

the gear and the handle configured to rotate in a first direction to move the first and second sections and simultaneously move the toe section and the heel section together to reduce a size of the boot and to rotate in a second direction to move the first and second sections and simultaneously move the toe section and the heel section apart to enlarge the size of the boot.

2. The water sport device of claim 1, further comprising a locking mechanism attached to the rail and being movable between locked and unlocked positions, the locking mechanism comprising an engagement tooth sized to engage with a row of locking teeth on the first section in the locked position to prevent movement of the first and second sections that enlarge the boot.

3. The water sport device of claim 2, wherein the engagement tooth and the row of locking teeth include angular faces to provide sliding movement of the first section relative to the engagement tooth while the locking mechanism is in the locked position to reduce the size of the boot while simultaneously preventing sliding movement of the first section relative to the engagement tooth to enlarge the size of the boot.

4. The water sport device of claim 1, wherein each of the first and second sections are arranged in an overlapping and parallel orientation between the boot and an outer edge of the support member.

5. The water sport device of claim 1, wherein the gear remains in constant contact with each of the rows of teeth on the first and second sections.

6. A water sport device for a user to ride over the surface of a body of water, the device comprising:

a support member to support the user on the surface of the body of water, the support member including a first side on which the user stands and an opposing bottom side;

a boot positioned on the top side and comprising a toe portion and a heel portion, the toe portion and the heel portion being separate from one another;

first and second rails mounted to the first side of the support member and extending along opposing lateral sides of the boot, each of the rails comprising:

first and second elongated members aligned in an overlapping arrangement between the boot and an outer edge of the support member, the first and second elongated members being movable relative to the support member, the first elongated member being attached to the toe portion and the second elongated member being attached to the heel portion;

a first row of engagement teeth extending along a first section of the first elongated member;

a second row of engagement teeth extending along the second elongated member;

a first adjustment mechanism mounted to the first rail and a second adjustment mechanism mounted to the second rail, each of the adjustment mechanisms configured to rotate in first and second directions and comprising a gear positioned between the first and second elongated members with gear teeth engaged with both the first and second rows of the engagement teeth;

the gear of each of the adjustment mechanisms being engaged with each of the first and second rows of engagement teeth with rotation of the gear in a first direction moving the first and second elongated members and moving the toe portion and the heel portion together, and rotation of the gear in the second direction moving the first and second elongated members and moving the toe portion and the heel portion apart.

7. The water sport device of claim 6, wherein each of the first and second rails further comprises a third elongated member fixedly attached to the support member and aligned with the first and second elongated members.

8. The water sport device of claim 6, further comprising a first locking member mounted to the first rail and a second locking member mounted to the second rail, each locking member comprising:

an engagement member with a tip sized to engage with the locking teeth; and a biasing member to bias the locking tooth into engagement with locking teeth one of the first and second elongated members.

the engagement member movable between locked and unlocked orientations, the engagement member preventing relative movement of the toe and heel portions away from each other in the locked orientation and allowing for relative movement of the toe and heel portions away from each other in the unlocked orientation.

9. The water sport device of claim 6, wherein each of the adjustment mechanisms include a handle that extends outward above the first side of the support member, each of the handles connected to the corresponding gear such that rotation of the handle rotates the gear.

10. The water sport device of claim 6, wherein each of the first and second elongated members of each of the rails are arranged in an overlapping and parallel orientation between the boot and an outer edge of the support member.

11. The water sport device of claim 6, wherein each of the gears remains in constant contact with the first and second rows of the engagement teeth.

12. A method of adjusting a boot on a water sport device, the method comprising:

separating a heel portion of the boot from a toe portion of the boot thereby moving first and second elongated members of a rail that extends along the boot to a first orientation, the first elongated member being connected to the toe portion and the second elongated member being connected to the heel portion;

rotating a gear that is positioned between and engaged with each of the first and second elongated members and moving each of the first and second elongated members along the gear to a second orientation thereby simultaneously moving the toe portion and the heel portion towards one another;

engaging an engagement tooth on a locking mechanism with a row of locking teeth on one of the first and second elongated members and preventing movement of the first and second elongated members that separates the toe portion and the heel portion; and while the engagement tooth of the locking mechanism is engaged with the row of locking teeth, rotating the gear and moving the each of the first and second elongated members along the gear to a third orientation and simultaneously moving the toe portion and the heel portion towards one another.

13. The method of claim 12, further comprising ratcheting the engagement tooth along the row of locking teeth while moving the first and second elongated members from the second orientation to the third orientation.

14. The method of claim 12, further comprising biasing the engagement tooth in a first direction and into engagement with the row of locking teeth.

15. The method of claim 12, further comprising disengaging the engagement tooth from the row of locking teeth and rotating the gear in an opposing direction and moving the first and second elongated members from the third orientation to the first orientation thereby moving the toe portion and the heel portion apart.

16. The method of claim 12, further comprising moving the first and second elongated members from the first orientation to the second orientation and into a greater amount of overlap.

17. The method of claim 12, further comprising rotating the gear through a handle that extends from the gear and that extends above a support to which the boot is attached.

* * * * *